US005394774A

United States Patent [19]

Dlask

[11] Patent Number: 5,394,774

[45] Date of Patent: Mar. 7, 1995

[54] POWER TONG WITH INTERCHANGEABLE JAWS

[75] Inventor: George Dlask, Edmonton, Canada

[73] Assignee: McCoy Bros. Group, A Corporate Partnership, Edmonton, Canada

[21] Appl. No.: 67,598

[22] Filed: May 27, 1993

[51] Int. Cl.[6] ..... B25B 17/00

[52] U.S. Cl. ..... 81/57.18; 81/57.2

[58] Field of Search ..... 81/57.18, 57.2, 57.21

[56] References Cited

U.S. PATENT DOCUMENTS 4,273,010 6/1981 Farr et al. ..... 81/57.18
4,469,362 9/1984 Schaarschmidt et al. ..... 81/57.18 X
4,709,599 12/1987 Buck ..... 81/57.18
5,044,232 9/1991 Schulze-Beckinghausen .... 81/57.18

FOREIGN PATENT DOCUMENTS 2100639 1/1983 United Kingdom ..... 81/57.18

*Primary Examiner*—James G. Smith

[57] ABSTRACT

A power tong that is adaptable to smaller sizes by installing an auxiliary camming assembly against the principle camming surface within the rotary. This auxiliary camming assembly preferably is seated within the neutral recess on the principle camming surface. An auxiliary cage plate carries auxiliary jaw sets.

6 Claims, 2 Drawing Sheets

POWER TONG WITH INTERCHANGEABLE JAWS

FIELD OF THE INVENTION

This invention relates to power tongs for use in rotating driller's pipe and the like. More particularly, it relates to a tong which is adaptable for use with a range of sizes of drill pipe, rod or casings.

BACKGROUND TO THE INVENTION

In the oil patch, power tongs are used to turn and make-up joints on tubing or drill rod as small as 1½ inches in diameter, and on pipe or casing ranging up to 16 inches in diameter, or more.

As an example of a power tong of the type which may employ the invention herein, reference may be made to U.S. Pat. No. 4,350,062 Farr et al. This patent describes a power tong having a power-driven rotary gear which has a camming surface formed along its inner circular face. This gear carries a jaw assembly as it rotates, the jaws being contained between cage plates that cap the upper and lower sides of the rotary gear. Both the rotary gear and the cage plates are "C"-shaped to provide access openings by which drill pipe may be placed centrally within these components.

The cage plates are free for rotation with respect to the rotary gear about their common center. However, the cage plates carry jaw assemblies that extend between the camming surface on the inside of the rotary gear, and the pipe which is to be turned. When the cage plate is rotated with respect to the rotary gear, cam followers on the jaw assemblies are advanced radially inward by the camming surface, until the jaws engage with the drill pipe. Further advancement of the cam followers up the cam surface locks the jaws to the pipe and arrests further relative rotation between the cage plates and the rotary gear. Thereafter, the pipe is turned by the continued rotation of the rotary gear, the force to effect rotation being transmitted through the jaws which are engaged with the pipe.

When the jaws are not in use they may be withdrawn from the central portion of the tong by the provision of a neutral recess formed in the rotary gear. This recess is located adjacent to the camming surface so that the cam follower roller may retire into it, allowing the jaws to swing outwardly from the tong centre.

The proper grasping of the drill pipe by the jaws depends on the relative rate of advancement of the jaws inwardly as the cam follower moves along the cam surface. The cam surface may be envisaged as a kind of curved wedge that is forced against the cam follower to urge the jaws inwardly. As with a wedge, the rate of increase of the inward gripping force applied by the jaws as the cam follower moves up the cam surface will depend upon the steepness of the cam surface. This ratio may be characterized in the "camming schedule".

If it is desired to convert a larger-size power tong, for example a 13⅜ inch tong, for use on smaller pipe, it may first be thought that the jaws need merely be made smaller and displaced towards the center, as by the insertion of spacers. However, the cam schedule necessary for use on larger size pipe will not reliably produce the gripping force needed on smaller pipe. Instead, such a straight forward modification will result in jaws which slip and score the smaller drill pipe.

A modification that will permit a larger power tong to be used on small pipe without causing slippage or scoring is therefore desirable.

Two patents which address this issue are U.S. Pat. No. 4,250,773 to Haynes, and U.S. Pat. No. 5,044,232 to Schulze-Beckinghausen.

In the Haynes patent, interchangeable jaws are described in which substitute cam follower assemblies for smaller pipe engage the same cam surfaces as used for larger pipe (column 3 line 68). In the Schulze-Beckinghausen reference, rollers of different diameter, and optionally different jaws, are substituted when it is desired to rotate pipe of a substantially different size. Unlike the more typical tong arrangement described above, the jaws of this design carry the cam surface and the cam following roller is mounted on the rotary gear. No reference is made, however, to the presence of a different camming surface, having a different camming schedule, in accordance with the size of pipe to be engaged.

Weatherford U.S. Inc., the assignee of the Schulze-Beckinghausen patent has published a brochure that refers to the use of an auxiliary cam arrangement, one separate auxiliary cam being used for jaws accommodating 4 to 5½ inch casing; and a second auxiliary cam being used for 2⅜ to 3½ inch casing. No reference is made, however, in this brochure as to the manner by which these auxiliary cams are employed within the tong.

It is with this background in mind that this invention has as an object to provide an improved means by which power tongs may be adapted for use with rod, tubing, pipe or casing having differing diameters.

The invention herein in its general form, will next be summarized, and then its implementation in the form of specific embodiments will be detailed with reference to the drawings following hereafter. These embodiments are intended to demonstrate the principle of the invention, and the manner of its implementation. As such they are merely exemplary. The invention will then be further described, and defined, in its most general and more specific forms by means of the series of claims which conclude this Specification.

SUMMARY OF THE INVENTION

According to the invention in one of its broader aspects, a power tong having a rotary gear with an inwardly-facing principal camming surface and a neutral recess for receiving a cam follower roller is provided with an auxiliary cam assembly having an auxiliary camming surface positioned inwardly from the principal camming surface, said cam assembly having a support post that is inter-fitted within the neutral recess whereby rotation of the rotary gear will effect rotation of the auxiliary cam assembly.

According to a further feature of the invention, the auxiliary cam assembly is provided with flange means which embrace the rotary gear, and are coupled thereto by locating pins.

By a further feature of the invention, the power tong is provided with a pair of principle cage plates, rotationally fitted on opposed sides of the rotary gear, the tong being further provided with a pair of auxiliary cage plates, respectively fitted over and connected to the principle cage plates, said auxiliary cage plates embracing and carrying an auxiliary jaw assembly.

By means of these structures, a power tong designed for use with larger size pipe may be converted to use with smaller size pipe, tubing or drill rod by installing the auxiliary cam assembly within the rotary gear, attaching the auxiliary cage plates to the principle cage plates and connecting the auxiliary jaw assembly in position between the auxiliary cage plates. Through use of an auxiliary cam assembly, a cam surface may be provided which has a camming schedule which is suited to the smaller sized pipe. By seating the auxiliary cam assembly through its support post within the neutral recess on the rotary gear, the full torque potential of the rotary gear may be transmitted to the auxiliary jaw assembly with a minimum of risk to the structural integrity of the rotary gear.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENTS

Figure 1:
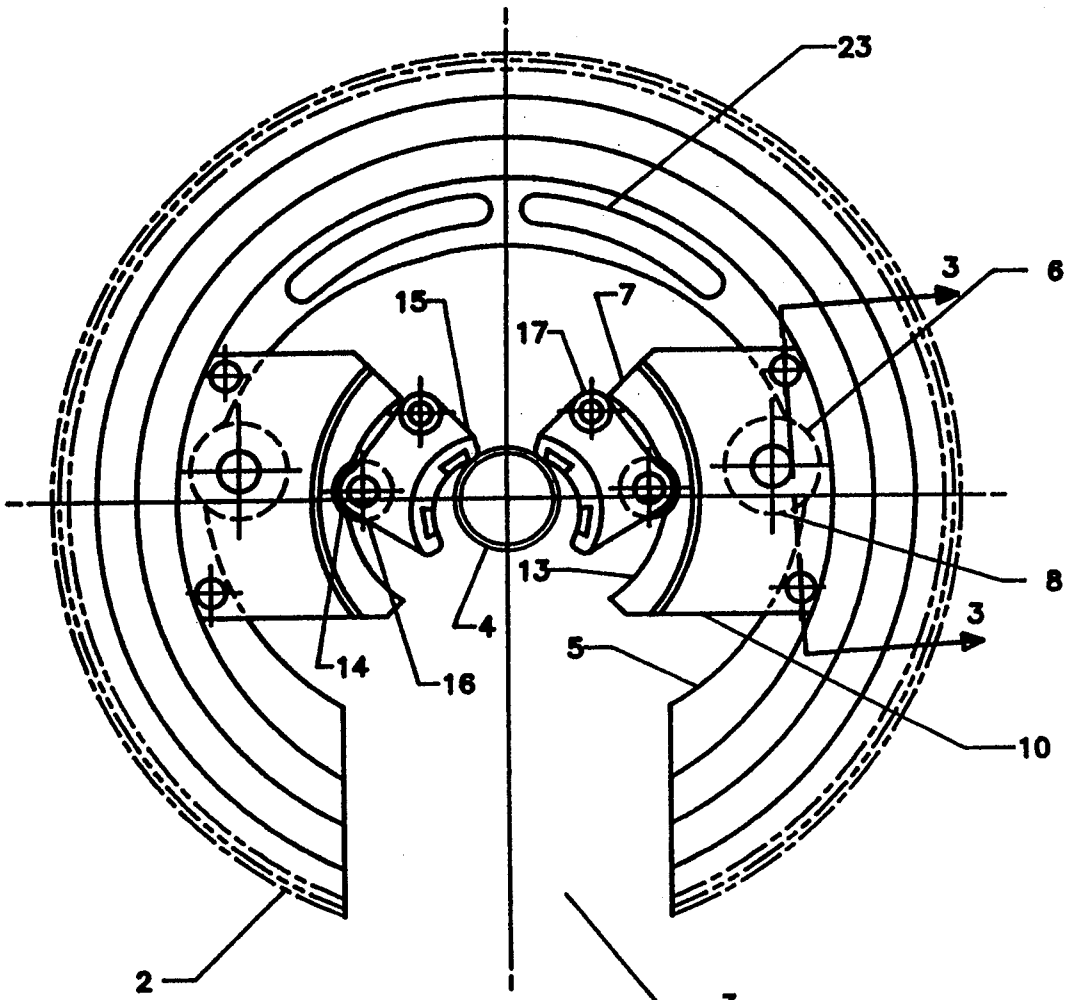
FIG. 1 is a plan view of a rotary gear with auxiliary jaw and cam assemblies positioned therein.

FIG. 1 shows a rotary gear 1 with an outer ring of teeth 2 by which the gear may be turned by a motor (not shown).

The gear 1 has a throat 3 to receive pipe 4 positioned centrally within the gear 1. The inwardly facing surface of the gear 1 is provided with a principal camming surface 5 which is intended to thrust cam followers on a standard jaw assembly (not shown) inwardly. A recess 6 to receive such cam followers, customarily a roller, interrupts the camming surface 5. When the cam follower on a standard jaw assembly enters this recess 6, the jaw assembly withdraws from the central portion of the gear 1, allowing pipe 4 to be located therein.

Figure 2:
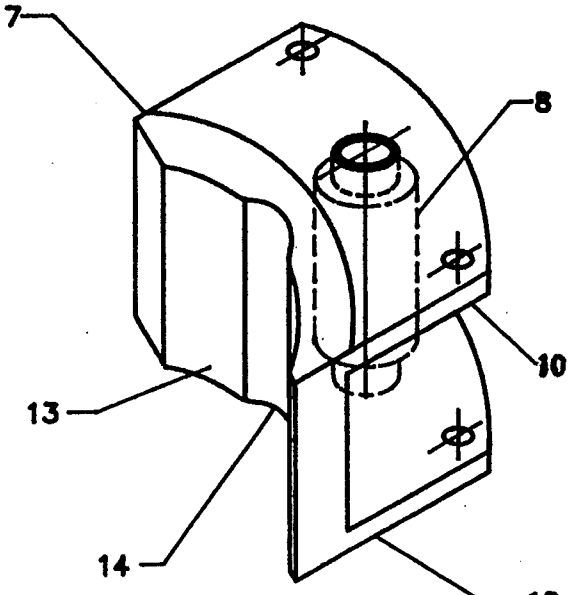
FIG. 2 is a perspective view of the auxiliary cam assembly showing its flanges 10 and the support post 8. Also shown in FIG. 3 is an auxiliary camming surface

The modified rotary gear 1 of the invention has an auxiliary cam assembly 7, shown separately in FIG. 2, positioned inside the rotary gear 1. This auxiliary cam assembly 7 has a support post 8 mounted on the cam assembly 7. This post may or may not be rotatably mounted, rotatability being merely a manufacturing convenience. When installed this post 8 fits intimately into the recess 6, these parts being generally complementary in shape over their contacting surfaces.

Figure 3:
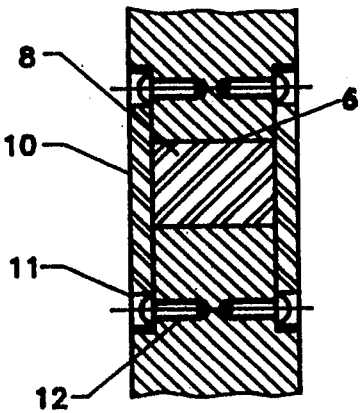
FIG. 3 is a cross-sectional view of the rotary gear 1 showing the locating pins 11 passing into the pin holes 11 through the auxiliary cam flanges 10.

The cam assembly 7 has flanges 10 which overly the rotary gear 1 on both its top and bottom sides. Locating pin 11 best shown in the cross-sectional view, FIG. 3, pass through these flanges 10 into pin holes 12 formed within the rotatory gear 1 to position the cam assembly 7 with the support post 8 nested within the recess 6.

It is highly preferable that these pins 11 be small in diameter to minimize the tendency of the pin holes 12 to weaken the rotary gear 1. This gear 1 is stressed with very high tensile loads when torque is applied to pipe, particularly when a frozen joint must been broken. As depicted, the pin holes 12 preferably do not pass entirely through the rotary gear 1 in order to minimize weakening of its structural integrity.

As shown in FIGS. 1 and 2 an auxiliary camming surface 13 is formed on the inner side of the auxiliary cam assembly 7. An auxiliary recess 14 is formed within the auxiliary camming surface 13. These parts perform the same function as the principle camming surface 5 and recess 6.

In FIG. 1, a pair of auxiliary jaws 15 are shown positioned within the rotary gear 1 with their cam follower rollers 16 seated in the auxiliary recess 14. The auxiliary jaws 15 pivot about pivot pins 17 that are journaled in an auxiliary cage plate 18 shown in FIG. 4. Collectively, the several auxiliary jaws with their cam followers 16 constitute an auxiliary jaw assembly.

Figure 4:
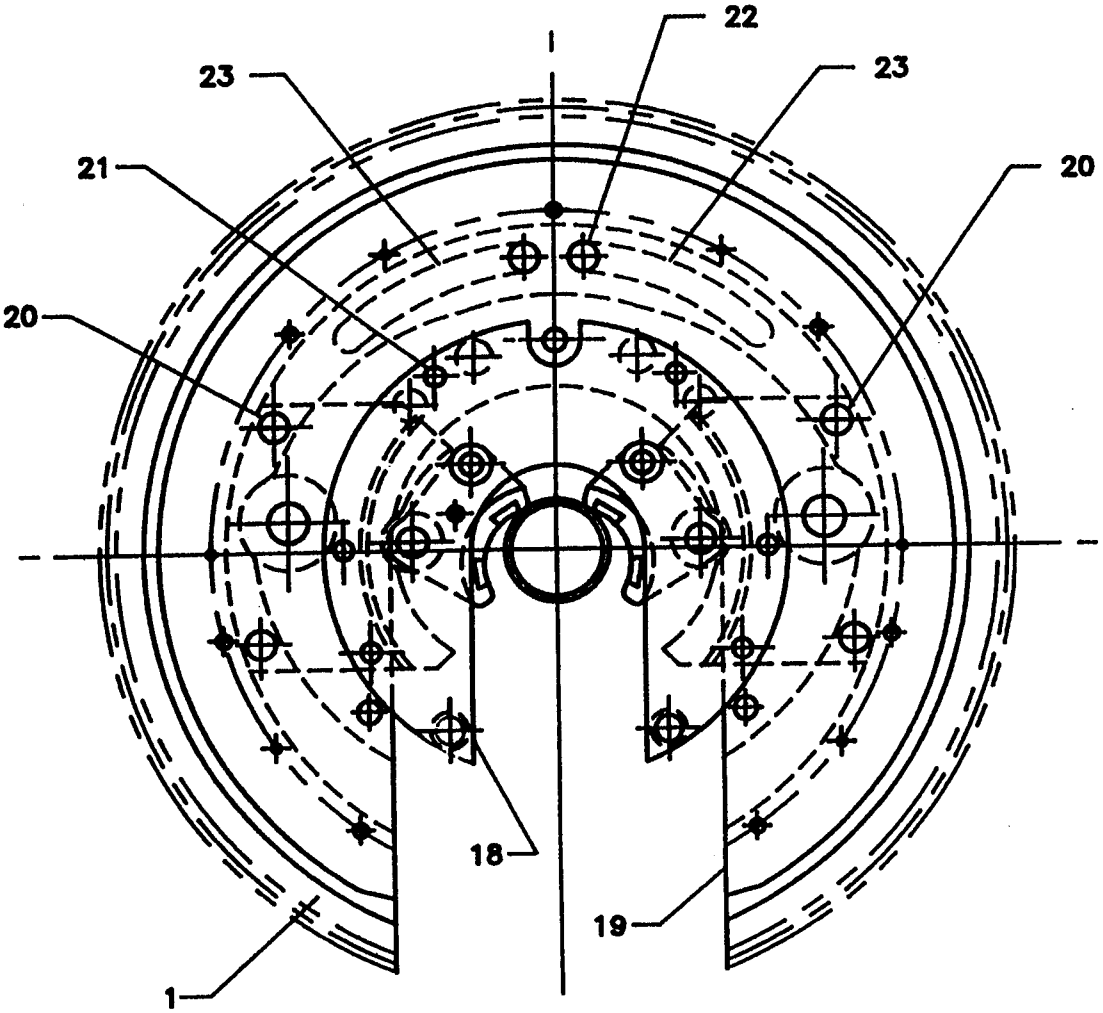
FIG. 4 is a plan view of the components of FIG. 1 with principal and auxiliary cage plates in place.

FIG. 4 shows the rotary gear 1 with two cage plates, a principle cage plate 19 and auxiliary cage plate 18. The function of the cage plate in a power tong is to support the pivot pins 17 that carry the jaws 15. These cage plates are free to rotate with respect to the rotary gear 1 until the jaws they carry are forced into engagement with pipe 4 by the action of the camming surfaces 13 against the cam followers 16.

In FIG. 4, the principle cage plate 19 has been modified by the presence of access holes 20 that permit insertion of the locating pins 11 into the rotary gear 1. As well, attachment holes 21 have been added to serve as part of the means by which the auxiliary cage plate 18 is fastened to the principle cage 19. Because the principle cage plate 19 is mounted for rotational motion with respect to the rotary gear 1, the auxiliary cage plate 18 is capable of a similar relative motion.

To prevent excessive relative motion between these plates and the gear 1 a limiting pin (not shown) is fitted through one of two limit pin access holes 22 so that the limit pins may enter slots 23 formed in the rotary gear 1. Two slots 23 are provided to allow the power tong to both make-up and break pipe joints.

In FIG. 4 all of the described parts are shown assembled for use in turning a pipe 4 of relatively smaller diameter. Because the auxiliary camming surface 13 is provided with a camming schedule, which has been selected taking into account the modified geometry arising from moving the auxiliary jaw assembly 15 inwardly, the auxiliary jaw assembly 15 will engage the pipe 4 with an appropriate grasping force, as torque is being applied to the pipe 4. The design of a camming surface to achieve such effect is a known exercise in the field and will not be described further.

The present invention provides for the introduction of auxiliary camming surfaces 13 into a power tong suited to turn larger sized pipe. It does so by the simple expedient of attaching the auxiliary cam assembly 7 to the rotary gear directly over the principal camming surface 5 of the rotary gear 1. This auxiliary cam assembly 7 is so attached with a minimal modification to the rotary gear 1, i.e. by use only of locating holes 12 of relatively small diameter, such holes preferably being blind holes that do not pass entirely through the rotary gear. In this manner, any reduction in the strength of the rotary gear 1 is minimized.

The transmission of torque from the rotary gear 1 to the auxiliary jaw assembly 15 is effected through reliance on the neutral recess 6 in the rotary gear. By intimately fitting the support post 8 on the auxiliary cam assembly 7 into this recess 6, the necessary force is developed at a location on the rotary gear 1 which has the strength to sustain the consequent stresses.

The use of an auxiliary cage plate 18 allows the pivot pins 17 of the auxiliary jaw assembly 15 to be ideally located.

The conversion of a power tong according to the invention from a larger to a small size merely requires the removal of the principle jaw assemblies, the installation of the auxiliary cam assembly, the fitting of the auxiliary cage plate 18 over the primary cage plate 19 and the installation of the auxiliary jaw assemblies 15 therebetween in the normal manner. This may readily be done at the job site by unskilled workers in a short period of time.

Conclusion

The foregoing has constituted a description of specific embodiments showing how the invention may be applied and put into use. These embodiments are only exemplary. Persons skilled in the art will be capable of adopting modifications to the embodiments described which will serve as equivalents, but still utilize the invention as set forth herein. The invention in its broadest, and more specific aspects, is further described and defined in the claims which now follow.

The embodiments of the invention in which an exclusive property is claimed are as follows:

1. A power tong for engaging pipe, said tong having a rotary gear with an inwardly-facing principal camming surface and a neutral recess, in combination with an auxiliary cam assembly having an auxiliary camming surface positioned inwardly from the principal camming surface and an auxilliary jaw assembly for engagement with said auxilliary camming surface wherein:

(1) the auxiliary cam assembly is connected to the rotary gear for rotation therewith without differential rotary displacement occurring between the rotary gear and auxiliary cam assembly, and (2) said cam assembly has a support post that is interfitted within the neutral recess whereby outward thrust by the auxiliary cam assembly upon engaging pipe is directed to the rotary gear at its neutral recess.

2. A power tong as in claim 1 wherein the auxiliary cam assembly is provided with flange means which embrace the rotary gear and are coupled thereto by locating pins.

3. A power tong as in claim 2 wherein the locating pins engage with the rotary gear through blind holes formed within the rotary gear that do not pass entirely through such gear.

4. A power tong as in claim 1 wherein the power tong is provided with a pair of principle cage plates, rotationally fitted on opposed sides of the rotary gear, the tong being further provided with a pair of auxiliary cage plates, respectively fitted over and connected to the principle cage plates, said auxiliary cage plates embracing and carrying on auxiliary jaw assembly.

5. A power tong as in claim 2 wherein the power tong is provided with a pair of principle cage plates, rotationally fitted on opposed sides of the rotary gear, the tong being further provided with a pair of auxiliary cage plates, respectively fitted over and connected to the principle cage plates, said auxiliary cage plates embracing and carrying on auxiliary jaw assembly.

6. A power tong as in claim 3 wherein the power tong is provided with a pair of principle cage plates, rotationally fitted on opposed sides of the rotary gear, the tong being further provided with a pair of auxiliary cage plates, respectively fitted over and connected to the principle cage plates, said auxiliary cage plates embracing and carrying on auxiliary jaw assembly.

* * * * *